US008006597B2

(12) United States Patent
Chiang

(10) Patent No.: US 8,006,597 B2
(45) Date of Patent: Aug. 30, 2011

(54) ROTARY TRIMMER HAVING MULTIPLE ROLLING BLADES

(76) Inventor: Tung-Lung Chiang, Yunlin County (TW)

( * ) Notice: Subject to any disclaimer, the term of this patent is extended or adjusted under 35 U.S.C. 154(b) by 514 days.

(21) Appl. No.: 12/284,373

(22) Filed: Sep. 22, 2008

(65) Prior Publication Data

US 2010/0071525 A1 Mar. 25, 2010

(51) Int. Cl.
*B26D 1/18* (2006.01)

(52) U.S. Cl. ..... 83/485; 83/614

(58) Field of Classification Search ..... 83/861–864, 83/746, 750, 751, 753, 202, 284, 483–489, 83/508.1–508, 495, 471.1, 618, 620
See application file for complete search history.

(56) References Cited

U.S. PATENT DOCUMENTS

| | | | | |
|---|---|---|---|---|
| 1,544,393 | A * | 6/1925 | Hatcher et al. | 29/251 |
| 5,168,788 | A * | 12/1992 | Kozyrski et al. | 83/863 |
| 5,322,001 | A * | 6/1994 | Boda | 83/485 |
| 5,611,255 | A * | 3/1997 | Evans | 83/614 |
| 5,671,647 | A * | 9/1997 | Mori | 83/56 |
| 6,990,884 | B2 * | 1/2006 | Tseng | 83/618 |
| 7,044,042 | B2 * | 5/2006 | Schultz et al. | 83/552 |
| 7,357,057 | B2 * | 4/2008 | Chiang | 83/614 |
| 7,415,915 | B2 * | 8/2008 | Parrish et al. | 83/617 |
| 7,845,261 | B2 * | 12/2010 | Chiang | 83/614 |
| 2005/0109180 | A1 * | 5/2005 | Schultz et al. | 83/455 |
| 2005/0172774 | A1 * | 8/2005 | Tseng | 83/614 |
| 2005/0223863 | A1 * | 10/2005 | Volfson et al. | 83/485 |
| 2006/0117925 | A9 * | 6/2006 | Volfson et al. | 83/485 |
| 2006/0219078 | A1 * | 10/2006 | Parrish et al. | 83/614 |
| 2007/0028738 | A1 * | 2/2007 | Chan | 83/485 |
| 2007/0125214 | A1 * | 6/2007 | Dong et al. | 83/485 |
| 2007/0157783 | A1 * | 7/2007 | Chiang | 83/485 |
| 2009/0013844 | A1 * | 1/2009 | Sudmalis et al. | 83/614 |

OTHER PUBLICATIONS

Parmley, R.O. ed. "Illustrated sourcebook of Mechanical Components" Chapter 9 "Locking and Clamping" McGraw Hill © 2000.*

* cited by examiner

*Primary Examiner* — Sean Michalski
(74) *Attorney, Agent, or Firm* — Charles E. Baxley

(57) ABSTRACT

A rotary trimmer having multiple rolling blades is provided with a knob for being rotated to drive a blade holder in a blade holder recess to rotate so as to shift the rolling blades. The blade holder recess and the blade holder are mutually positioned by spring elements and positioning recesses. Besides, the knob can be retained from rotating by a latch.

9 Claims, 6 Drawing Sheets

ROTARY TRIMMER HAVING MULTIPLE ROLLING BLADES

BACKGROUND OF THE INVENTION

1. Technical Field

The present invention relates to a rotary trimmer that comprises multiple rolling blades. More particularly, the present invention relates to a rotary trimmer that holds a plurality of rolling blades wherein said rolling blades providing different cutting functions are replaceably assembled to the rotary trimmer for satisfying various cutting needs.

2. Description of Related Art

When a traditional guillotine paper trimmer is implemented to cut a stack of paper, one potential problem is that paper sheets tend to slip off the stack under the downward cutting force. A rotary paper trimming device therefore developed to provide a transverse trimming force comprises a cutting plate, a sliding rail, a slider, and a blade holder, wherein the slider is configured to slide along the sliding rail and the blade holder is designed to hold a rolling blade. For adapting such rotary paper trimming device to paper in a wide range of thickness, some position adjusting elements are typically provided between the blade holder and the slider for positioning them with respect to each other. When there is a need to change the rolling blade currently installed in the blade holder, it is necessary to disassemble the slider from the sliding rail so as to reveal the blade holder settled therein. While such blade-replacing operation is troublesome and time-consuming in a way, it also puts a user who replaces the rolling blade with his hands under the risk of being slashed by the blades. Hence, the prior art device is inferior in safety and needs to be improved.

SUMMARY OF THE INVENTION

The primary objective of the present invention is to provide a rotary trimmer equipped with multiple rolling blades. The rotary trimmer allows a user to alternatively implement the rolling blades with cutting functions he desires without disassembling the rotary trimmer from the sliding rail of a rotary trimming device for replacing the rolling blades of different cutting functions. Moreover, the rotary trimmer has its blade holder and slider combined firmly so as to protect a user from being accidentally slashed during his use of the rotary trimmer.

According to the present invention, the rotary trimmer having multiple rolling blades comprises:

a slider, including a partition and a side cover, both connected to a top plate, wherein a blade holder recess is formed between the partition and the side cover;

a blade holder, settled in the blade holder recess and having a rotating shaft positioned between the partition and the side cover, wherein the rolling blades are held by the blade holder and arranged around the rotating shaft of the blade holder with cutting edges thereof partially projecting from a periphery of the blade holder;

a knob, provided at an exterior of the side cover and having a driving shaft connected to the rotating shaft of the blade holder so as to drive the blade holder to rotate for shifting the rolling blade to be used to a predetermined position where the cutting edge of the rolling blade to be used projects from edges of the partition and the side cover; and at least one spring element and a plurality of positioning recesses formed on the side cover and the blade holder, respectively, so that the spring element can be alternatively combined with one said positioning recess.

Basing on the aforementioned structure, the knob further has a plurality of ports and the side cover further has a receiving portion that receives a latch. The latch is shiftable to be coupled with or separated from one said port of the knob. Furthermore, the side plate is formed with at least one hole while the latch has at least one tenon so that when the tenon is coupled with the hole, the latch is retained in the receiving portion so as to ensure firm combination between the latch and the corresponding port.

BRIEF DESCRIPTION OF THE DRAWINGS

The invention as well as a preferred mode of use, further objectives and advantages thereof, will best be understood by reference to the following detailed description of an illustrative embodiment when read in conjunction with the accompanying drawings, wherein.

DETAILED DESCRIPTION OF THE PREFERRED EMBODIMENTS

Figure 1:
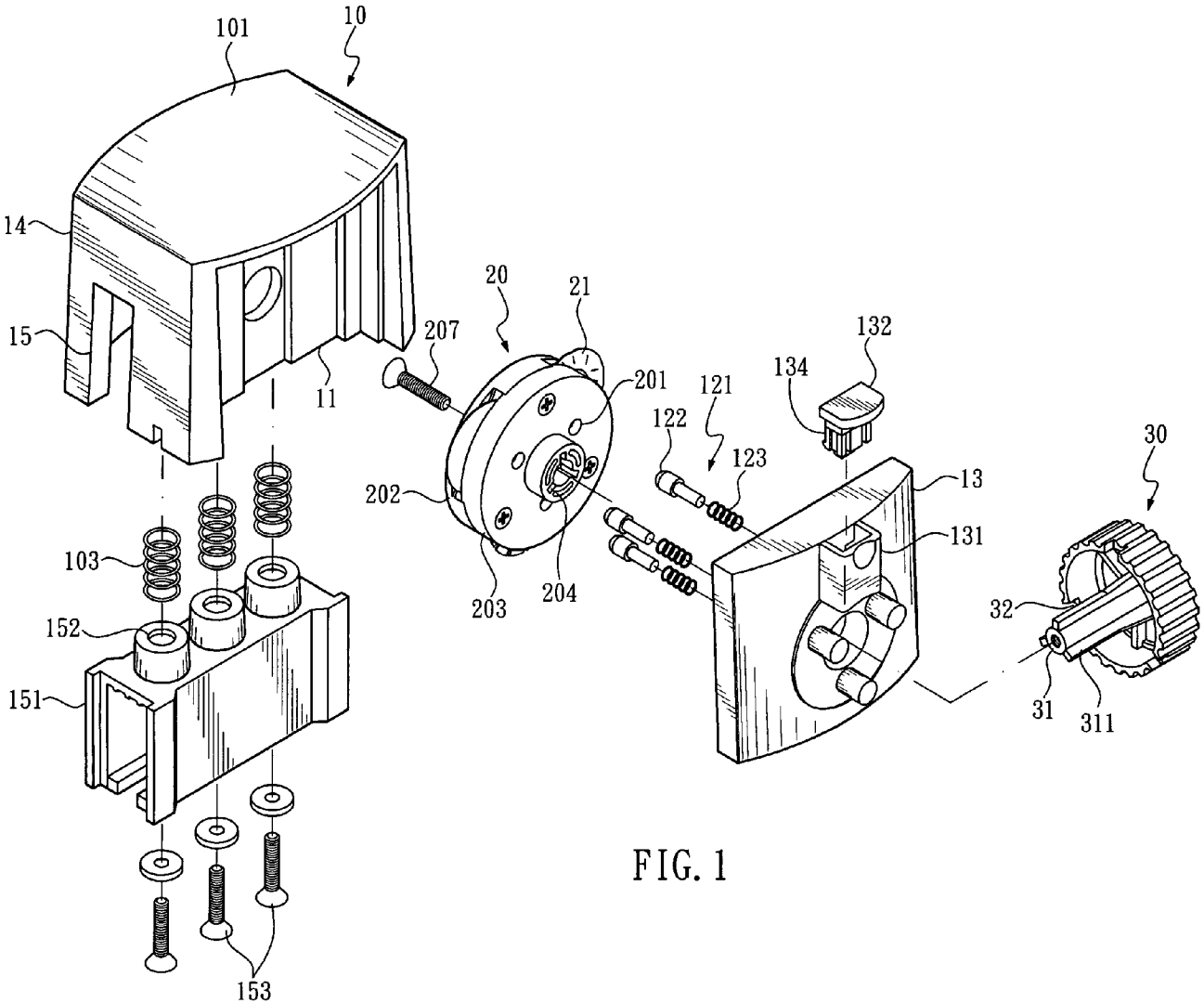
FIG. 1 is an exploded view of a rotary trimmer of the present invention.
Figure 2:
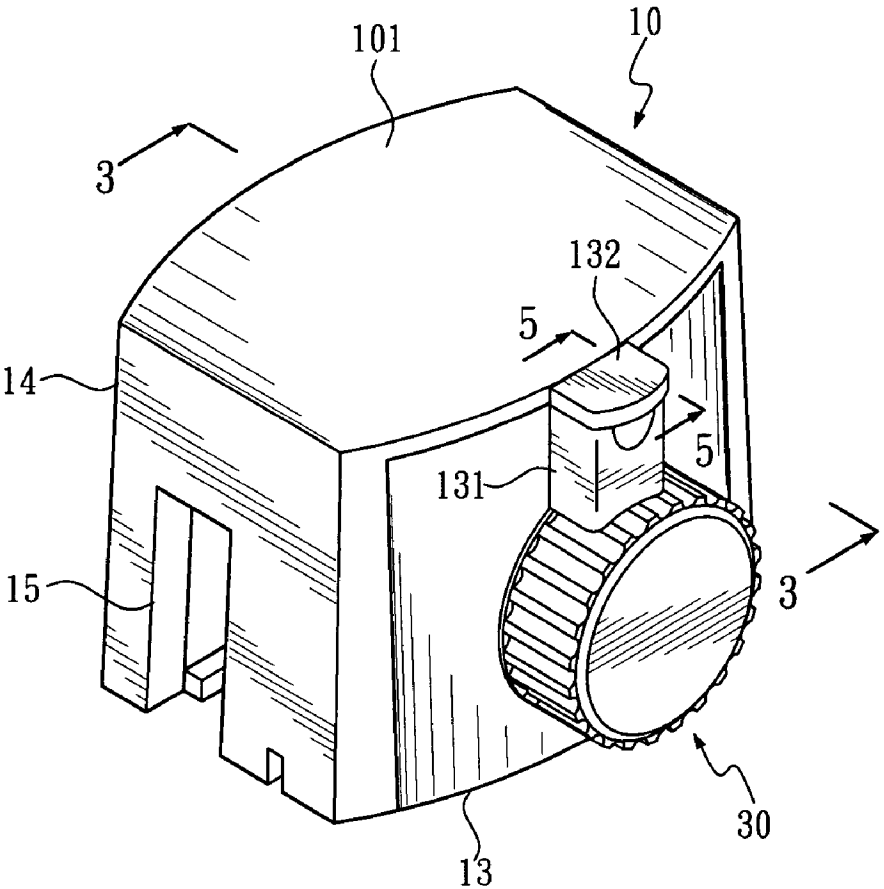
FIG. 2 is an assembled perspective view of the rotary trimmer of the present invention.

While a preferred embodiment is provided herein for illustrating the concept of the present invention as described above, it is to be understood that the components in these drawings are made for better explanation and need not to be made in scale. Moreover, in the following description, resemble components are indicated by the same numerals.

Please refer to FIGS. 1, 2, 3 and 6 for a rotary trimmer of the present invention, wherein the rotary trimmer holds multiple rolling blades that may provide different cutting functions. The rotary trimmer includes a slider 10 constructed from a partition 11 and a lateral plate 13 that are coupled with the top plate 101. The slider 10 further comprises a side plate 14 coupled with the top plate 101. A groove 15 is formed between the partition 11 and the side plate 14 for accommodating a sliding block 151, which has at least one hole 152 formed at a top thereof. The top plate 101 is formed with at least one fastening hole 102 so as to allow a screw 153 that passed through the hole 152 to be coupled therewith. A compression spring 103 has two ends thereof pushing against the sliding block 151 and the top plate 101. A blade holder recess 12 is formed between the partition 11 and the side cover 13. The slider 10 is to be slidably combined with a sliding rail fixed on a cutting plate so that the rotary trimmer can be easily moved along the sliding rail by a user to a desired site for trimming paper. At this time, the user can press the rotary trimmer toward the paper and thus cut the paper by the rolling blade 21. When the user stops pressing the rotary trimmer, the compression spring 103 returns the rolling blade 21 to its initial position and thus lift the rolling blade 21 from the paper.

Figure 3:
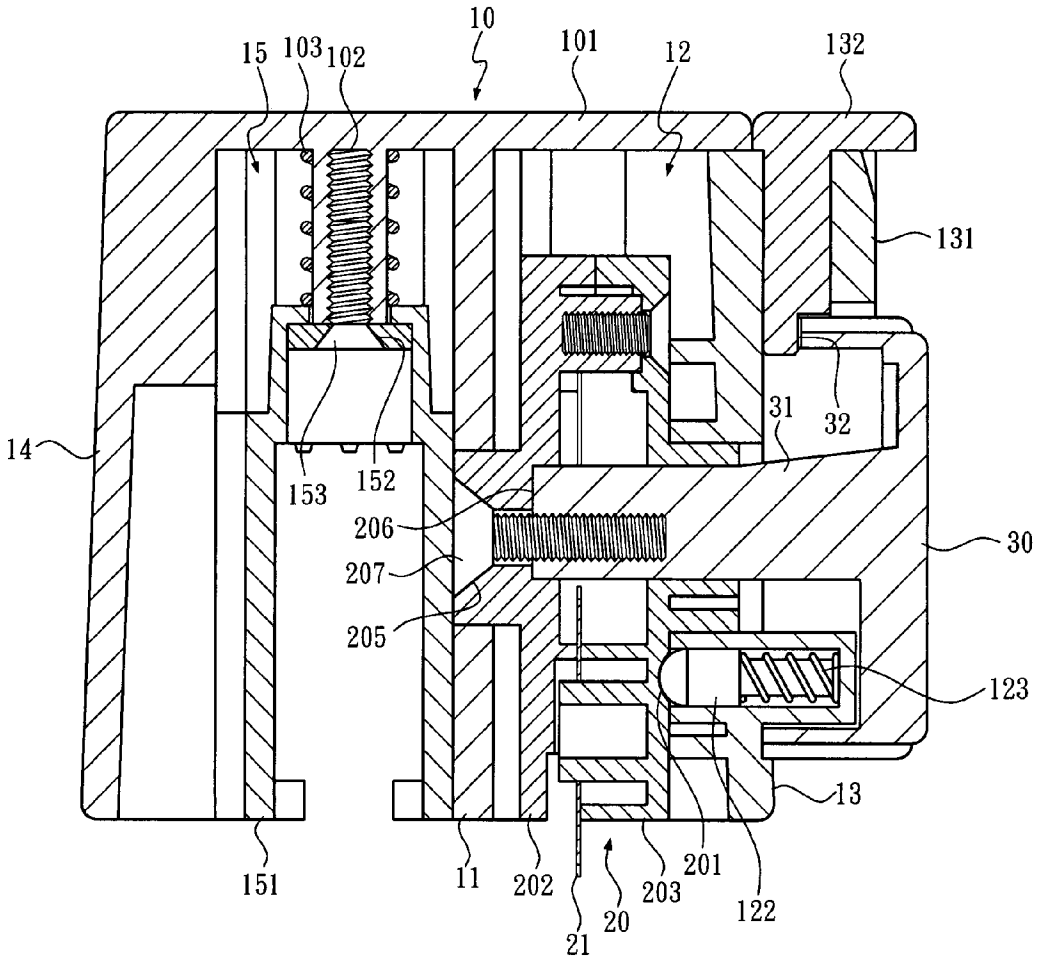
FIG. 3 is a cross-sectional view of the rotary trimmer taken along Line 3-3 of FIG. 2, wherein a rolling blade to be used is shifted to a predetermined position and fixed at the position by a spring element.
Figure 4:
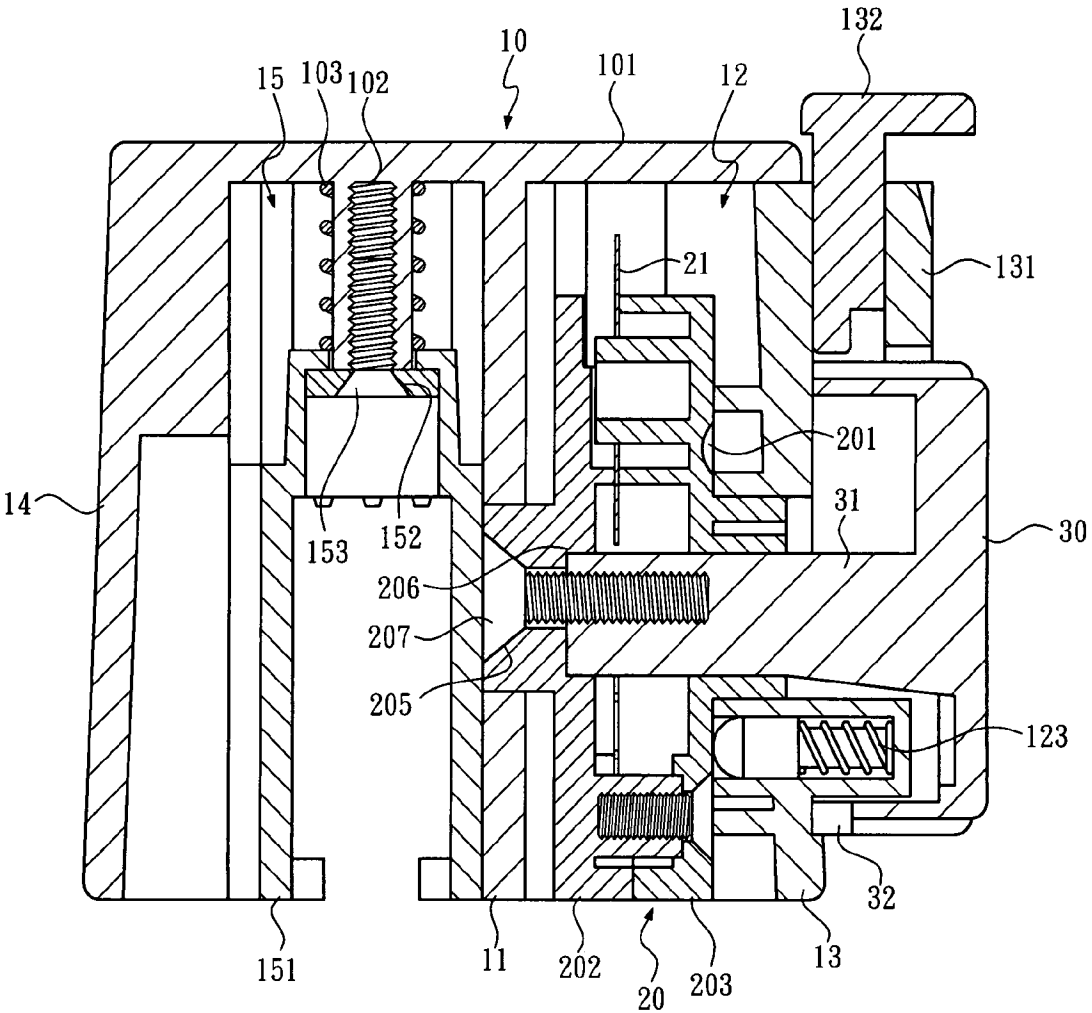
FIG. 4 is another cross-sectional view according to FIG. 3, showing the rolling blades being shifted.

Referring to FIGS. 3 and 4, a blade holder 20 is received in the blade holder recess 12 and a rotating shaft thereof is positioned between the partition 11 and the side cover 13. The blade holder 20 is provided with a plurality of said rolling blades 21 that are arranged around the rotating shaft. The blade holder 20 comprises a first portion 202 and a second portion 203 that are combined with each other. The rolling blades 21 are rotatably retained between the first portion 202 and the second portion 203 so that cutting edges of the rolling blades 21 partially project from a periphery of the blade holder 20. A knob 30 is settled at an exterior of the side cover 13 and has a driving shaft 31 at a center thereof. The driving shaft 31 is coupled with the rotating shaft of the blade holder 20 so as to drive the blade holder 20 to rotate and thereby change positions of the rolling blades 21. The rolling blade 21 for instant use is shifted to a predetermined position where its cutting edge project from edges of the partition 11 and the side cover 13. At least one spring element 121 and a plurality of positioning recesses 201 are formed on the side plate 13 and the blade holder 20, respectively, for being coupled with each other. The spring element 121 comprises a spring 123 abutting against the side cover 13 and a pin 122 propped by the spring 123. The pin 122 has a hemispheric end received by one said positioning recess 201. Thereby, when the knob 30 is rotated, the blade holder 20 is driven to rotate and in turn the pin 122 of the spring element 121 is pushed by a surface of the blade holder 20. As a result, the spring 123 is compressed for storing energy and the rolling blade 21 is brought into the blade holder recess 12 until the positioning recess 201 of the blade holder 20 is combined with the spring element 121 again. When the blade holder 20 is combined with the spring element 121, the spring 123 pushes the pin 122 into the positioning recess 201 and the rolling blade 21 projects from the edges of the partition 11 and the side plate 13 again.

Figure 5:
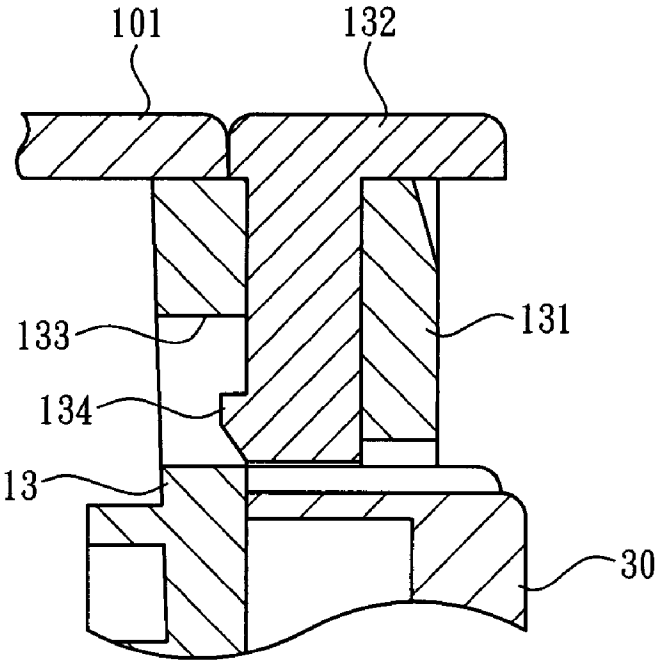
FIG. 5 is another cross-sectional view of the rotary trimmer taken along Line 5-5 of FIG. 2, depicting a receiving portion and a latch of the rotary trimmer.
Figure 6:
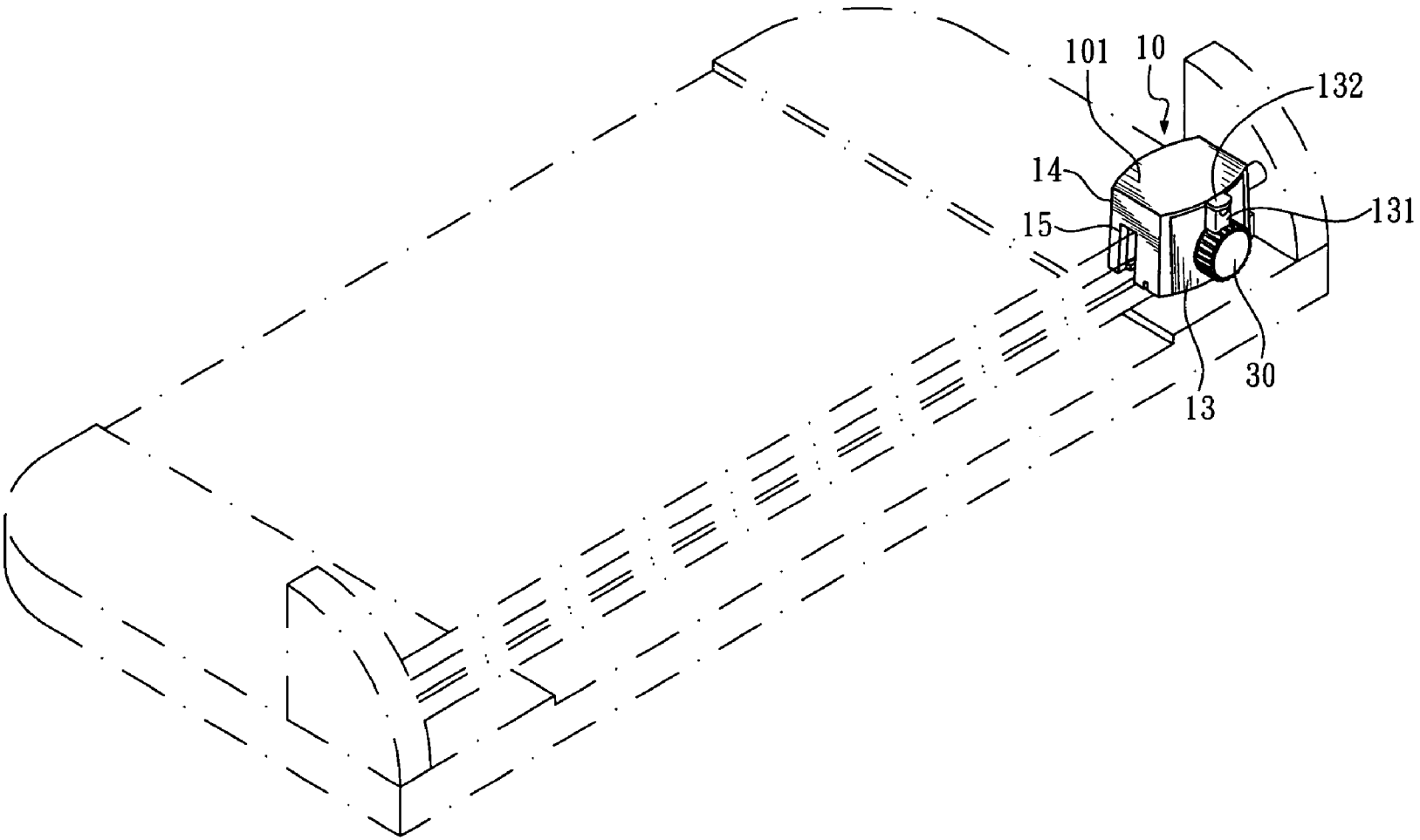
FIG. 6 is a schematic drawing showing the rotary trimmer of the present invention assembled to a cutting plate.

Reference is now made to FIGS. 3, 4 and 5. The side cover 13 has a receiving portion 131 and a latch 132 settled in the receiving portion 131 wherein the latch 132 is shiftable in the receiving portion 131 so to be coupled with or separated from the knob 30. The side plate 13 is formed with at least one hole 133 while the latch 132 has at least one tenon 134. When the latch 132 is separated from the knob 30, the tenon 134 is coupled with the hole 133. The knob 30 has its periphery formed with ports 32 of an amount equal to that of the rolling blades 21 for being alternatively coupled with the latch 132 so as to hold the rolling blade to be used at the predetermined position and prevent the blade holder 20 from rotating under a counterforce from the slider 10 when the rotary trimmer is sliding.

Now seeing FIGS. 1 and 3, the driving shaft 31 of the knob 30 is axially connected to the rotating shaft of the blade holder 20. A plurality of ridges 311 and a plurality of notches 204 are respectively formed at a periphery of the driving shaft 31 and an inner wall of the rotating shaft of the blade holder 20 for being coupled with each other. The first portion 202 has a counterbore 205 on the rotating shaft for receiving a screw 207 that is screwed into a center of the driving shaft 31. The first portion 202 also has a receiving segment 206 on the rotating shaft of for receiving an end of the driving shaft 31. The first portion 202 further has an annular flange formed on the rotating shaft for being combined with the partition 11 so that when the knob 30 is rotated, it can smoothly drive the blade holder 20 to shift the desired rolling blade 21 to the predetermined position.

Although the particular embodiment of the invention has been described in detail for purposes of illustration, it will be understood by one of ordinary skill in the art that numerous variations will be possible to the disclosed embodiment without going outside the scope of the invention as disclosed in the claims. recess.

What is claimed is:

1. A rotary trimmer having multiple rolling blades, the rotary trimmer comprising:

a slider for traversing a rail, including a partition and a side cover, both connected to a top plate, wherein a blade holder recess is formed between the partition and the side cover;

a blade holder, settled in the blade holder recess and having a portion formed as a rotating shaft which rotates about a rotational axis and is positioned between the partition and the side cover, wherein the rolling blades are settled on the blade holder and arranged around the rotating shaft of the blade holder with cutting edges thereof partially projecting from a periphery of the blade holder;

said rolling blades rotate about axes which are parallel to said rotational axis;

a knob, provided at an exterior of the side cover and having a driving shaft connected to the rotating shaft of the blade holder so as to drive the blade holder to rotate for shifting the rolling blade to be used to a predetermine position where the cutting edge of the rolling blade to be used partially projects from edges of the partition and the side cover;

and at least one spring element and a plurality of positioning recesses formed on the side cover and the blade holder, respectively, so that the spring element can be alternatively combined with one said positioning recess;

wherein the side cover has a receiving portion forming a channel perpendicular to said rotational axis and a latch settled in the receiving portion, in which the latch is shiftable in the receiving portion in a direction perpendicular to said rotational axis to be coupled with or separated from the knob;

wherein the knob has a periphery provided with ports for being alternatively coupled with the latch.

2. The rotary trimmer of claim 1, wherein the spring element comprises a spring abutting against the side cover and a pin propped by the spring, in which the pin has a hemispheric end received by one said positioning recess.

3. The rotary trimmer of claim 1, wherein the side plate is formed with at least one hole positionally corresponding to the receiving portion while the latch has at least one tenon so that when the latch is separated from the knob, the tenon is coupled with the hole.

4. The rotary trimmer of claim 3, wherein the driving shaft of the knob is axially connected to the rotating shaft of the blade holder while a plurality of ridges and a plurality of notches are formed at a periphery of the driving shaft of the knob and an inner wall of the rotating shaft of the blade holder, respectively, for being coupled with each other.

5. The rotary trimmer of claim 1, wherein said ports are provided in an amount equal to an amount of the rolling blades.

6. The rotary trimmer of claim 5, wherein the first portion has a counterbore formed on the rotating shaft for receiving a screw that is screwed into a center of the rotating shaft.

7. The rotary trimmer of claim 5, wherein the first portion has a receiving segment formed on the rotating shaft for receiving an end of the driving shaft of the knob.

8. The rotary trimmer of claim 1, wherein the blade holder comprises a first portion and a second portion that are combined with each other and the rolling blades are rotatably retained between the first portion and the second portion.

9. The rotary trimmer of claim 1, wherein the slider further comprises a side plate coupled with the top plate, a groove formed between the partition and the side plate, a sliding block accommodated in the groove, in which said sliding block has at least one hole at a top thereof while said top plate has at least one fastening hole so that a screw passing through the hole is coupled with the fastening hole, and a compression spring has two ends thereof pushing against the sliding block and the top plate.

* * * * *